US010926577B1

(12) United States Patent
DeCamillis et al.

(10) Patent No.: US 10,926,577 B1
(45) Date of Patent: Feb. 23, 2021

(54) ELECTRIC GRAVER, SYSTEM AND METHOD FOR JEWELERS

(71) Applicant: Christian DeCamillis, Traverse City, MI (US)

(72) Inventors: Christian DeCamillis, Traverse City, MI (US); David Johnson, Waynesville, OH (US)

(73) Assignee: Christian DeCamillis, Traverse City, MI (US)

( * ) Notice: Subject to any disclaimer, the term of this patent is extended or adjusted under 35 U.S.C. 154(b) by 260 days.

(21) Appl. No.: 16/128,944

(22) Filed: Sep. 12, 2018

Related U.S. Application Data

(60) Provisional application No. 62/557,941, filed on Sep. 13, 2017.

(51) Int. Cl.
*B44B 11/02* (2006.01)
*A44C 27/00* (2006.01)

(52) U.S. Cl.
CPC ..... *B44B 11/02* (2013.01); *A44C 27/00* (2013.01)

(58) Field of Classification Search
CPC ..... B44B 11/02; A44C 27/00; B25D 9/04; B25D 17/06; B25D 2250/035; B25D 2250/121; B24B 23/00
See application file for complete search history.

(56) References Cited

U.S. PATENT DOCUMENTS

| | | | |
|---|---|---|---|
| 3,201,670 A | 8/1965 | Myers | |
| 4,903,784 A | 2/1990 | Glaser | |
| 7,762,347 B2 | 7/2010 | Glaser et al. | |
| 9,079,286 B1 * | 7/2015 | DeCamillis | B24B 23/02 |

FOREIGN PATENT DOCUMENTS

| | | |
|---|---|---|
| CN | 2706338 Y | 6/2005 |
| CN | 204309491 U | 5/2015 |

* cited by examiner

*Primary Examiner* — Chelsea E Stinson
(74) *Attorney, Agent, or Firm* — Northern Michigan Patent Law, PLC

(57) ABSTRACT

A solenoid-driven graver having improved feel and handling characteristics. The graver is controlled by a user-operated foot pedal having novel sensor and response characteristics, through a programmable controller allowing the user to select the desired response of the solenoid in the graver in proportion to pedal rotation.

11 Claims, 8 Drawing Sheets

-12°
MIN

-10°
MIN

0°
MIN

10°
FULL

12°
MAX

0%

50%

100%

0%

50%

100%

FIG. 8A
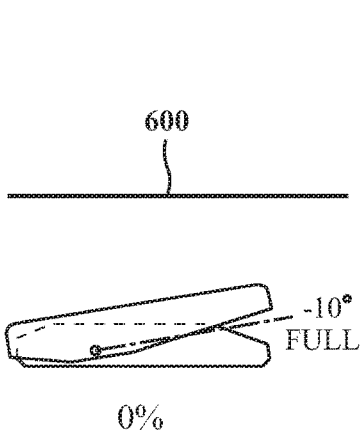
FIG. 8B
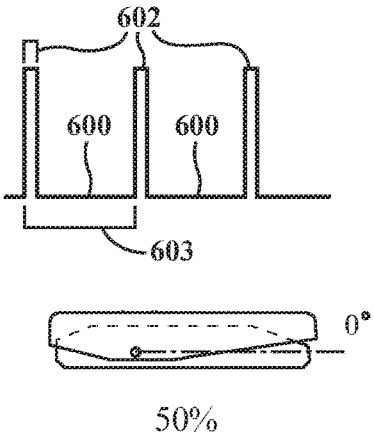
FIG. 8C
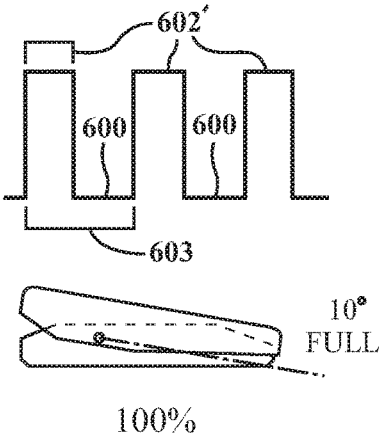
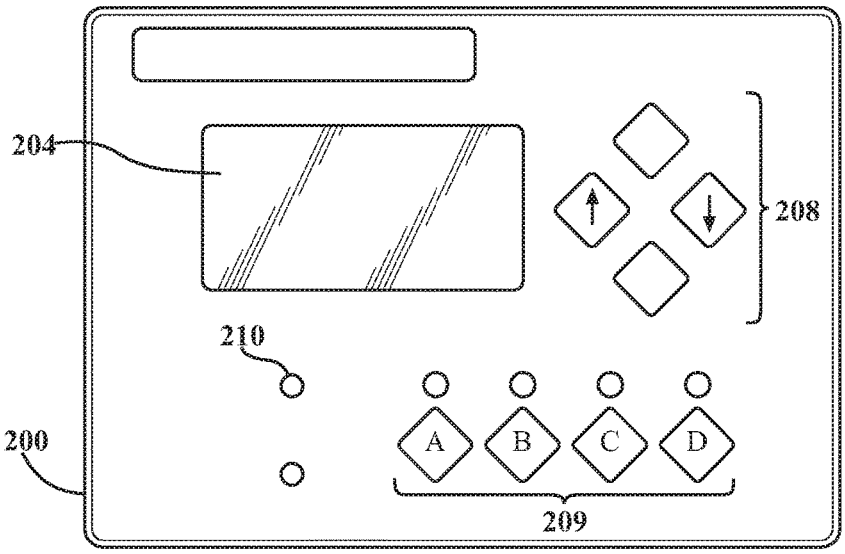
FIG. 9

ELECTRIC GRAVER, SYSTEM AND METHOD FOR JEWELERS

RELATED APPLICATIONS/PRIORITY BENEFIT CLAIM

This application claims the benefit of U.S. Provisional Application No. 62/557,941, filed Sep. 13, 2017 by the same inventors (DeCamillis and Johnson), the entirety of which provisional application is hereby incorporated by reference.

FIELD

The subject matter of the present application is in the field of powered impact-type engraving tools and their control systems, typically used by jewelers for fine engraving work.

BACKGROUND

Impact-type engraving tools or "gravers" are well known for use by jewelers when doing fine work on jewelry. Gravers typically have a hollow handle or grip supporting a hardened adjustable tip impacted by an internal piston. The most common type of graver is pneumatically-operated, where the tip is placed against a workpiece and air is pulsed into the handle from an exterior source, driving the piston to strike the tip (or an anvil contacting the tip) to remove material from the workpiece. One such pneumatic graver tool is shown in my U.S. Pat. No. 9,079,286.

Controlling the speed and force of the graver stroke is important for control over the engraving work. A common type of control system for driving pneumatic gravers uses a control box with valves and a controller for regulating the delivery of air to the graver from a pressure source. The control box is typically activated with a foot pedal connected to the box via an air conduit. Two such pedal-operated pneumatic graver control box systems are shown in U.S. Pat. No. 4,903,784 to Glaser and U.S. Pat. No. 7,762,347 to Glaser et al.

Precise, repeatable, controlled piston strokes with good "feel" are of critical importance to skilled jewelers and engravers. While prior pneumatic graver systems have attempted to provide better control over piston force and speed in various ways, there is significant room for improvement.

One approach has been to replace the pneumatic motive force in an engraving device with an electric one, via a solenoid electromagnetically driving the piston.

One solenoid-driven engraving device is shown in Chinese patent publication CN 2706338Y. This appears to be a basic handheld impact engraving tool, apparently for use in "eagle pecking" type carving in place of traditional chisel tools, with the stated advantages of reduced wear on the tool and a higher degree of repeatability and consistency imparted to the chisel stroke.

Another solenoid-driven engraving tool is shown in Chinese patent publication CN 204309491U, apparently designed for stone carving or surfacing, wherein an internal shock absorbing system and an adjustable cap associated with needle or tip are presumed to ensure a consistent impact on the stone's surface.

Prior solenoid-based gravers such as the above appear to be fairly simple, designed for basic engraving or carving techniques in inexpensive materials, and it is believed that they would not provide the "feel" and control desired by a jeweler for truly fine work on more expensive materials. It is also believed that these prior solenoid engravers would get too hot to handle with prolonged use, and would not be useful for fine engraving in which a curl of metal is removed from the workpiece with a push-like force imparted by the tool as a whole, versus a dot- or stippling-type action which displaces rather than removes the material.

BRIEF SUMMARY

The present invention is a handheld solenoid-driven graver, and an associated control system and method, to provide the fine feel and control over the piston stroke prized by jewelers.

The handheld graver comprises a fixed-position graver tip held in a heat-conductive forward stylus tube, and a hollow rear handle section made from a heat-insulating material like plastic or wood. A push-type solenoid unit is mounted in the hollow handle, with a "piston" or plunger (hereafter plunger) reciprocating in a solenoid tube or housing and connected to an actuator rod extending through a forward interface end of the solenoid to selectively strike an anvil or base portion of the graver tip in the stylus tube. The forward interface end of the solenoid is connected to the stylus tube with a heat sink connection, for example a threaded metal-to-metal connection, while an insulating air gap spaces the insulating wall of the handle section from the remainder of the solenoid housing rearwardly of the heat sink connection, except for a rear insulating connection between a rear portion of the insulating handle material and a rear portion of the solenoid tube or housing.

The hollow handle further includes air flow holes adjacent the forward interface end of the solenoid unit, the holes communicating with the insulating air gap between the handle and solenoid to permit ambient air to flow over the heat sink connection and to the interior of the grip around the solenoid housing.

An adjustable backstroke stop is located at the rear of the handle section, to adjust the stroke of the plunger.

The control system for the handheld graver includes a foot pedal, the pedal communicating with the handheld graver to supply electrical power to the solenoid in the graver to control the plunger stroke. The foot pedal in a preferred form includes a potentiometer or optical input sensor to the control system which dynamically supplies power in a controlled gradient to the solenoid driver, allowing smooth adjustment of plunger force and speed. The control pedal is configured with a unique pedal input range, from a physically limited neutral or no-power position inclined toward the user, through a flat mid-range position, to a physically limited maximum deflection position inclined away from the user. The pedal response is set with adjustable dead zones at minimum and maximum, i.e. where a pre-set degree of motion at either end of the pedal's range is calibrated by a controller to result in no change to the solenoid's operation.

The control system for the handheld graver includes a foot pedal. The pedal is the primary user input to the control system that maps the user input to a variety of electrically driven pulse forms which supplies electrical power to the solenoid in the graver to control the plunger stroke. The foot pedal in a preferred form includes either a potentiometer as the angle sensor or an optical sensor to provide the input signal to the control system over a wide physical range as to provide a controlled gradient to the solenoid driver, allowing smooth adjustment of plunger force and speed and increased controllability for the user. The control pedal is configured with a unique pedal input range, from a physically limited neutral or no-power position inclined toward the user, through a flat mid-range position, to a physically limited maximum deflection position inclined away from the user. The pedal response is set with adjustable dead zones at minimum and maximum, i.e. where a pre-set degree of motion at either end of the pedal's range is calibrated by a controller to result in no change to the solenoid's operation.

The control system in a further form includes a controller connected to (or incorporated in) the foot pedal for adjusting the response of the pedal; for optimizing the "duty cycle" or pulse width of the solenoid with a fixed frequency; for mapping pedal input to solenoid pulse rate, pulse train, and/or pattern; for mapping pedal input to an increasing frequency with a fixed pulse width; and for providing a soft start option in which the solenoid is activated to reciprocate in the handheld graver without striking the graver tip, providing an audible and tactile signal to the user that the graver tip is about to begin removing material from the workpiece.

In a further form, the invention includes a method of optimizing a solenoid pulse rate in a handheld graver controlled by a foot pedal, where solenoid pulse rate is mapped to pedal deflection in non-linear fashion over the pedal deflection range. In still a further form, the method of optimizing includes adjusting both pulse length and/or rate to provide "burst" and "train" patterns of pulses.

In a further form, the invention includes a method of optimizing various solenoid pulse effects in a handheld graver controlled by a foot pedal, where these effects are mapped to pedal deflection in a user selectable linear and non-linear fashion over the pedal deflection range. In still a further form, the method of optimizing includes adjusting both pulse length, pulse frequency, and combinations thereof, to provide "burst" and "train" patterns of pulses.

These and other features and advantages of the invention will become apparent from the detailed description below, in light of the accompanying drawings.

BRIEF DESCRIPTION OF THE DRAWINGS

FIGS. 8A-8C are schematic representations of a pedal responsive variable pulse width mapping method according to the invention.

FIG. 9 is a detail view of the controller interface and keypad of FIG. 3.

DETAILED DESCRIPTION

Figure 1:
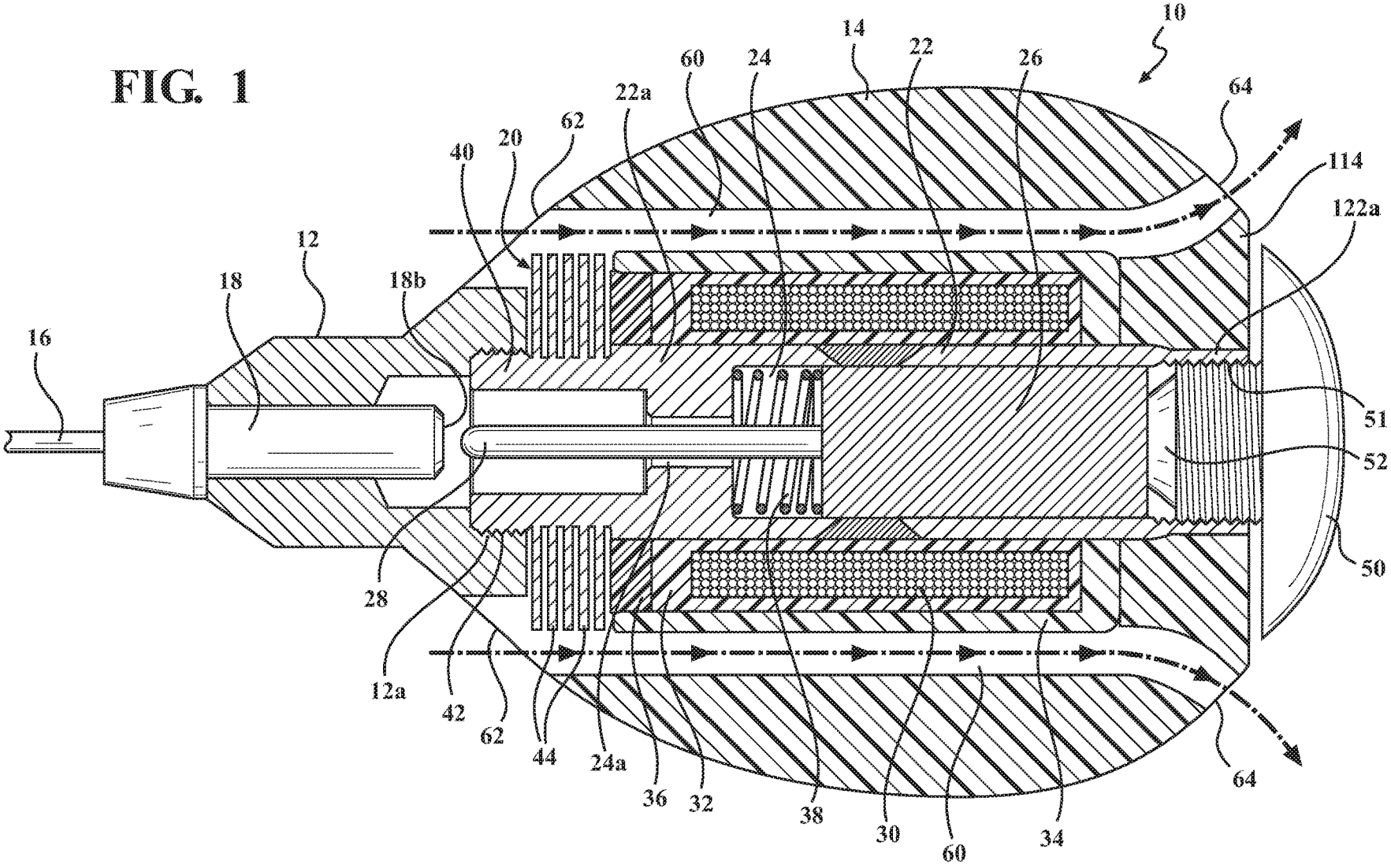
FIG. 1 is a side section view of an example handheld graver according to the invention, with a solenoid plunger in a deactivated position.
Figure 2:
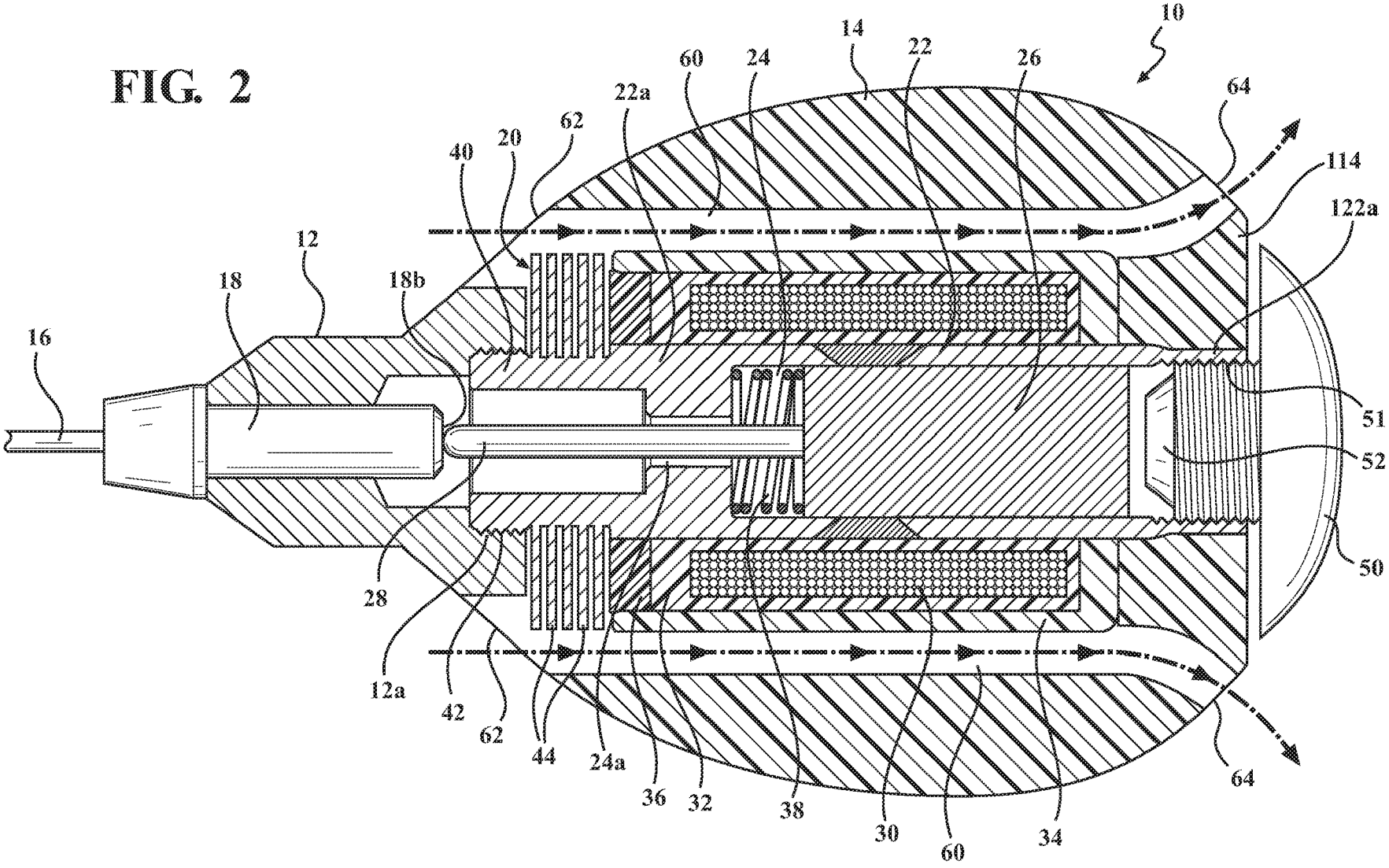
FIG. 2 is similar to FIG. 1, but showing the solenoid plunger in an activated position.

Referring first to FIGS. 1 and 2, a handheld graver tool 10 is shown in example form in order to teach how to make and use the claimed invention. Graver 10 has a forward stylus tube 12 made from a heat-conductive metal such as steel or aluminum, and a larger diameter rear handle 14 made from a heat-insulating material such as wood or plastic, the material choices not being limited to these examples provided the stylus tube 12 is a heat-conducting metal and the handle 14 is a heat-insulating non-metal.

Stylus tube 12 supports a known type of graver tip 16 made from a material such as tungsten carbide or hardened steel, the graver tip fixed in an anvil 18 which in turn is fixed in the outer end of stylus tube 12 in known manner. A strike to the base 18*b* of anvil 18 accordingly exerts a forward force on graver 10 as a whole, which then shifts forward to move graver tip 16 into and through the material being engraved.

The hollow interior of handle 14 contains a solenoid unit 20 of generally known type, in the illustrated example a commercially available push-type solenoid unit having a solenoid tube or housing 22, a plunger bore 24, a plunger 26 capable of reciprocating back and forth in the plunger bore 24, an actuator or push rod 28 extending through a rod bore 24*a* formed in a forward end 22*a* of the solenoid tube 22, a magnet coil 30 encapsulated at 32 in an outer housing 34 around the solenoid tube 22, and an electrical power connector 36 for receiving electrical power to selectively energize the coil 30. A return spring 38 is located between the forward end of plunger 26 and a forward end 22*a* of the solenoid tube, normally urging plunger 26 rearwardly to a de-energized position in the plunger bore.

The forward end of the solenoid has a plug-like stylus connection interface portion 40, either integrally formed with the solenoid or added thereto, comprising external threads 42 screwed into matching internal threads 12*a* in the rear of the stylus tube in a heat conductive metal-to-metal fit. Stylus connection interface 40 also includes an array of heat sink fins 44, in the example a circular array of axially spaced fins, located behind the connection threads 42. While a threaded metal-to-metal connection is illustrated and preferred between the forward end of the solenoid and the stylus tube, other types of heat-conductive metal-to-metal connections would be possible.

The rear end of solenoid unit 20 is attached to graver 10 at a rearmost portion 114 of handle 14, which may comprise the sole or at least the primary connection between the handle and the metal solenoid unit. For example, the rear end of solenoid tube 22 is formed as an open cylinder, or has its original end closure removed, and is closed off with a length-adjustable backstroke stop 50 threaded at 51 into threads 122*a* formed in the rear end of the solenoid tube bore. An inner plug portion 52 of backstroke stop 50 extends partway into solenoid tube 22 to provide a backstop, limiting the rearward motion of plunger 26 in bore 24. Backstroke stop 50 can be threaded into the rear of handle 14 partway or fully, thereby adjusting the "stroke" or length of travel of solenoid plunger 26 according to the length/extent of the threaded connection between backstroke stop 50 and solenoid tube 22 or handle 14.

Backstroke stop 50 is made from a heat insulating material such as wood or plastic, similar to handle 14, in order to minimize heat transfer from the metal body of solenoid tube 22 to the handle. Thus the only metal-to-metal contact between the solenoid unit 20 and the graver is at the forward threaded stylus interface connection 42, 12*a*.

To further insulate the exterior of handle 14 from heat generated by the solenoid, the remainder of the handle between stylus interface connection 40 and rear backstroke stop 50 is spaced from the solenoid unit by an air gap 60 that extends around the exterior of the solenoid unit. Airflow holes 62 and 64 are formed in the forward and rearward ends of handle 14, allowing cooling air to flow through the handle around the solenoid unit. Forward air holes 62 are in close proximity to heat sink fins 44, allowing cooling air to flow in over the fins to remove heat from the fins. The air is exhausted through rear air holes 64 by convection, as the graver is often held at various angles and such that a chimney effect from one set of air holes to the other is created through the handle. Fins 44 are preferably spaced from contact with the inner surface of handle 14 for better air flow.

FIG. 1 shows plunger 26 in its resting or de-energized position, forced rearwardly against backstroke stop 50 by spring 38. When solenoid coil 30 is energized, plunger 26 is electromagnetically urged forward against the bias of spring 38, driving the push rod against anvil 18 as shown in FIG. 2 and imparting material-removing force to the graver tip 16.

The solenoid plunger may be driven into contact with the anvil by either attracting or repelling the plunger forward against the return spring, depending on the preferred coil arrangement.

The frequency and duration of electrical current applied to the solenoid determines the duty cycle, which is the ratio of the solenoid ON time to the total of its ON plus OFF time for one complete cycle of operation, i.e. one strike in which the plunger moves fully forward to strike the anvil and then returns. Controlling the duty cycle and other pulse effects by controlling the electrical current intermittently delivered to the solenoid is critical for very fine control over the "feel" of the graving operation.

Figure 3:
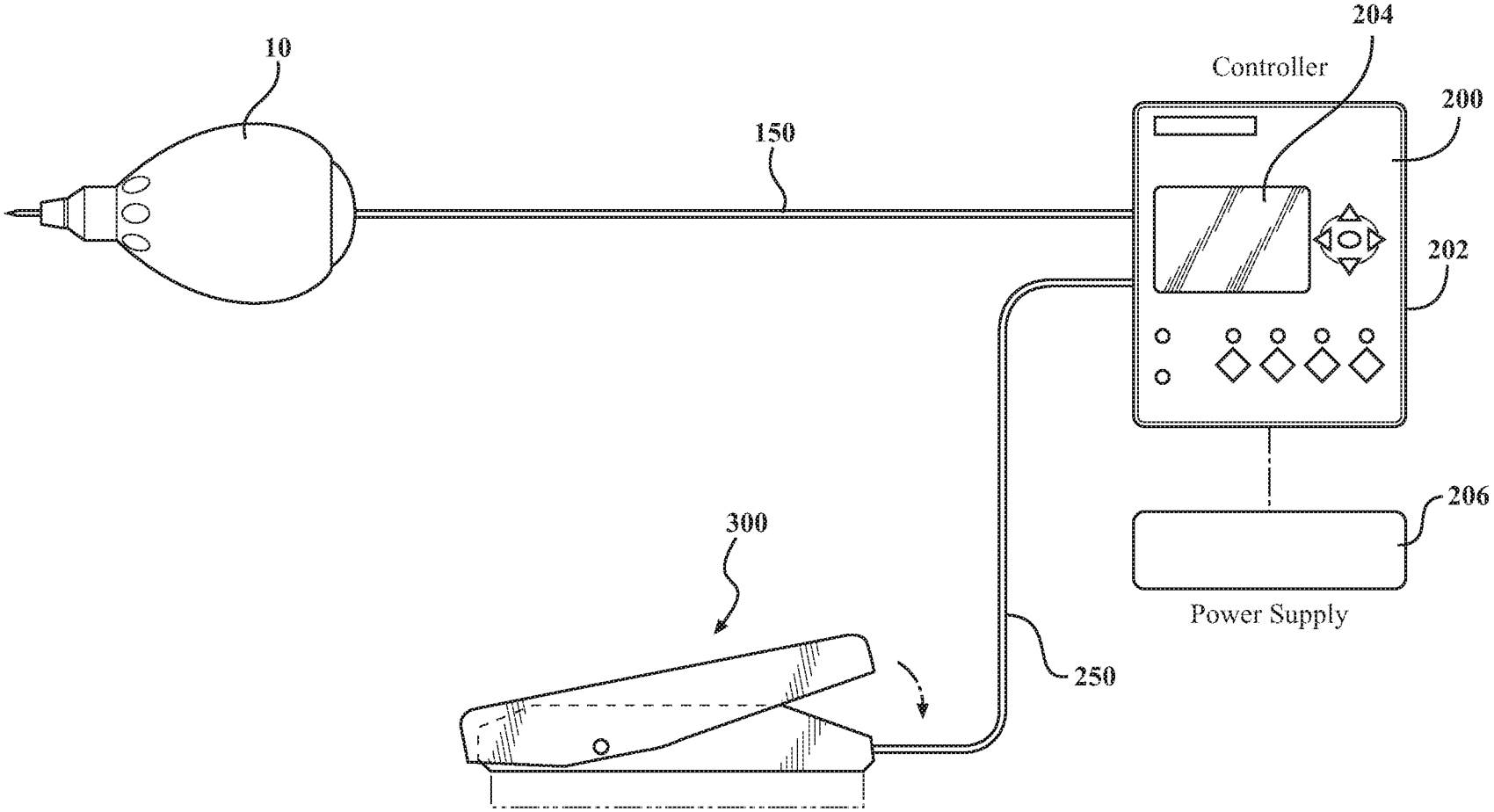
FIG. 3 is a drawing of the primary components of an example system according to the invention, incorporating the graver of FIG. 1. It shows a separate pedal and controller enclosure. An optional configuration allows the control elements to be included inside the pedal housing.

Referring now to FIG. 3, graver 10 is shown connected to a power supply and control system 100 comprising a microprocessor based controller 200 and a foot pedal 300, via suitable wired signal and power connections 150, 250 in the illustrated example, although the signal connection from pedal 300 to controller 200 may be a wireless one. While FIG. 3 shows the controller and foot pedal as separate items, it is possible to integrate the two by incorporating the controller physically into the foot pedal, although certain features such as a visual display screen might need to be limited or omitted.

Figure 3A:
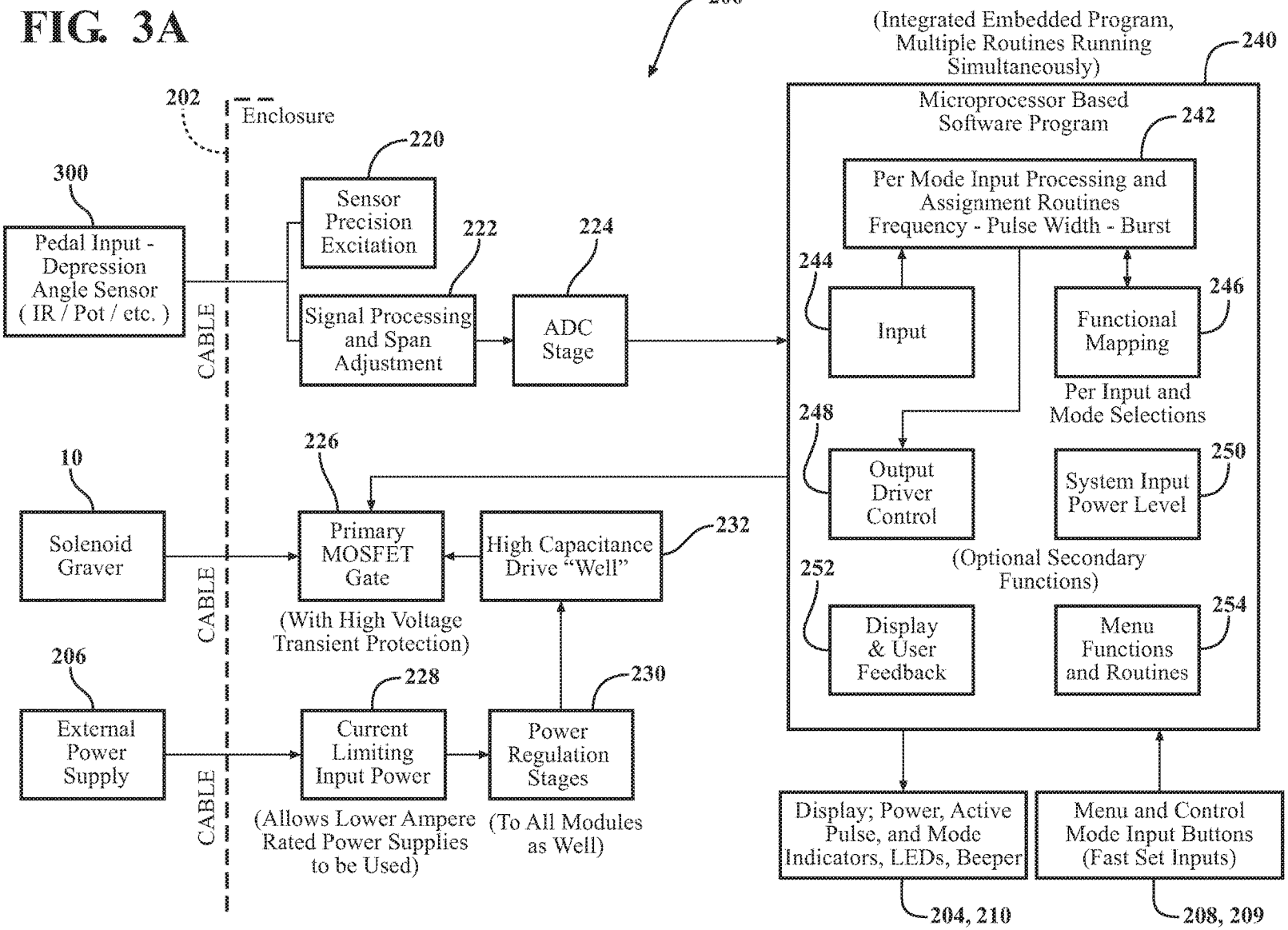
FIG. 3A is a schematic block diagram of the functional electronics and software programming modules of the controller in FIG. 3.

Controller 200 may comprise, for example, a known type of programmable electronic controller or discrete microprocessor circuit, with functional modules including power processing, sensor processing, microprocessor based operation, display and configuration menu, and solenoid drive stage as schematically shown in FIG. 3A. The physical form and function of the controller and its programming according to the principles of the invention will be understood and available to those skilled in the art, and may take different forms. In the illustrated example, controller 200 comprises an electronics enclosure 202 featuring an LCD display 204 selectively showing status, operating modes, settings, options, user input prompts, and menus, user input keys or equivalent touch entry features 208, and operating status and/or power indicator LEDs 210 (FIGS. 3 and 9). Controller 200 may be configured to run off a conventional power supply, for example a 24 VDC/1.5 amp power source 206. While the incoming voltage may vary according to the requirements of the solenoid used within the safety limits allowed by the power input stage 228, it is desirable to use a higher voltage supply than needed by the solenoid, and to charge a capacitor bank in the controller with the incoming high voltage to create a "well" 232 from which a load can pull higher amperage current in short bursts to energize the solenoid in the graver, much higher than the power supply used.

The primary function of the controller 200 is to drive the solenoid 20 in graver 10 with variable pulse or duty cycle characteristics. This may include providing the controller with a drive stage having a cascade MOSFET driven gate stage 226 supplied by the above-described large capacitor bank 232, although a simpler, higher-amperage power supply of equivalent voltage could be used instead.

Regardless of voltage, power variations are essentially controlled by active ON time, and controller 200 can be programmed according to the invention for a pulse "train" mode in which the frequency measures the time between single regularly-spaced pulses (FIGS. 6A-6C) in response to physical user input, or for a pulse "burst" mode in which frequency measures the time between bursts of multiple regularly-spaced pulses (FIGS. 7A-7C) in response to physical user input. In both modes, physical user input is made through foot pedal 300 and its unique operating method. The manner in which the controller 200 responds to physical user input from the pedal's operation is based on pre-programmed modes stored in the microprocessor memory which can be selected by the user through the controller interface using keypad inputs 208 and 209, for example one or more pre-programmed pulse "train" modes and one or more pre-programmed pulse "burst" modes.

FIG. 3A shows the functional electrical hardware and software elements of the controller or control system in schematic form. Standard circuitry elements provide and enable all power handling, sensor signal processing, input and output functions. All software resides in a programmable microprocessor unit, comprising a microcontroller, FPGA, or CPLD integrated circuit. All user input, active and saved settings, sensor input, input-to-output mapping, and output driver synthesis happen within this module. A menu driven selection tree allows a user to configure the device across all settings, modes, and features. Ample feedback is provided to the user via an LCD or similar display, LED indicators, and audible beepers. A number of stored configurations are saved in non-volatile memory and easily accessible with a two button press action referred to as Fast Set modes, for example using keypad inputs 209.

The microprocessor has internal analog to digital converters to sample power levels and the primary sensor input (the pedal). Once read, the sensor voltage level, now a number in an internal register, is first scaled to incorporate a low end dead zone, linear input range, and an upper end max zone and maintained as the processed input 244. Once this is characterized, the relative input is read by mode specific routines 242 and mapped within that routine to a series of outputs based on the settings previously configured by the user. The mapping routines 246 combine the processed input 244 with numerous settings. After the mapping conversion is complete, each mode generates its own output pulse pattern 248 according to the selections for that mode as entered by the user. For example in the pulse width mode with fixed frequency pictured in FIGS. 8A-8C, pre-selected values of the output frequency, range of duty cycle ON time, and response curve are all used to translate the input to a specific output pattern 248. The numerical input 224 could be a series of routines allow the user to switch from operating mode to allow changes in the settings or configuration 254. In the illustrated example, the controller microprocessor 240 interfaces with an LCD or similar display 204, and a series of LED and audible cues 210 provide user feedback and display status and operating features. Further, user input is interfaced with the controller via menu and fast set buttons 208, 209. System power 250 is also sampled and displayed as part of the LED cluster 210.

Figure 4A:
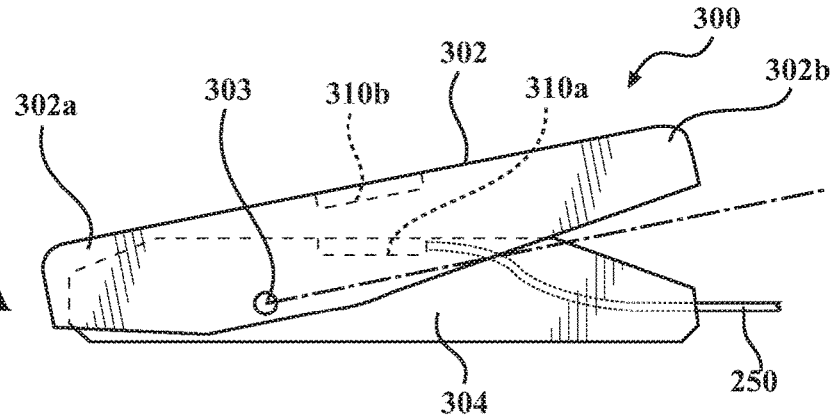
FIGS. 4A-4E are side views of an example pedal for use in the system of FIG. 3, showing a range of pedal deflection positions and a preferred set of calibrated system responses over the range.
Figure 4B:
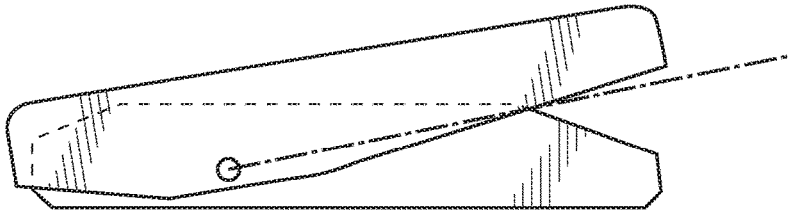
Figure 4C:
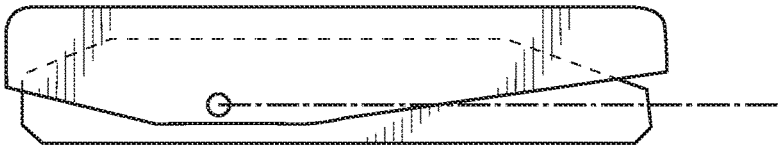
Figure 4D:
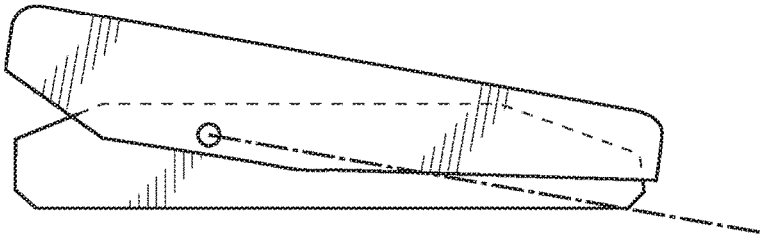
Figure 4E:
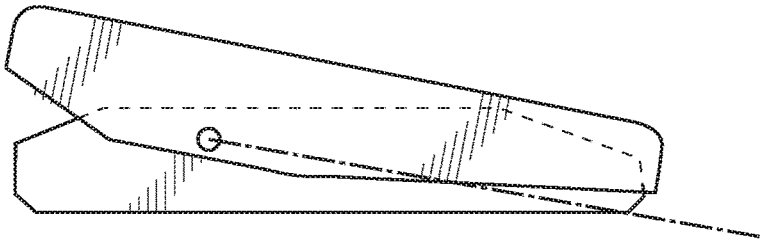
Figure 5:
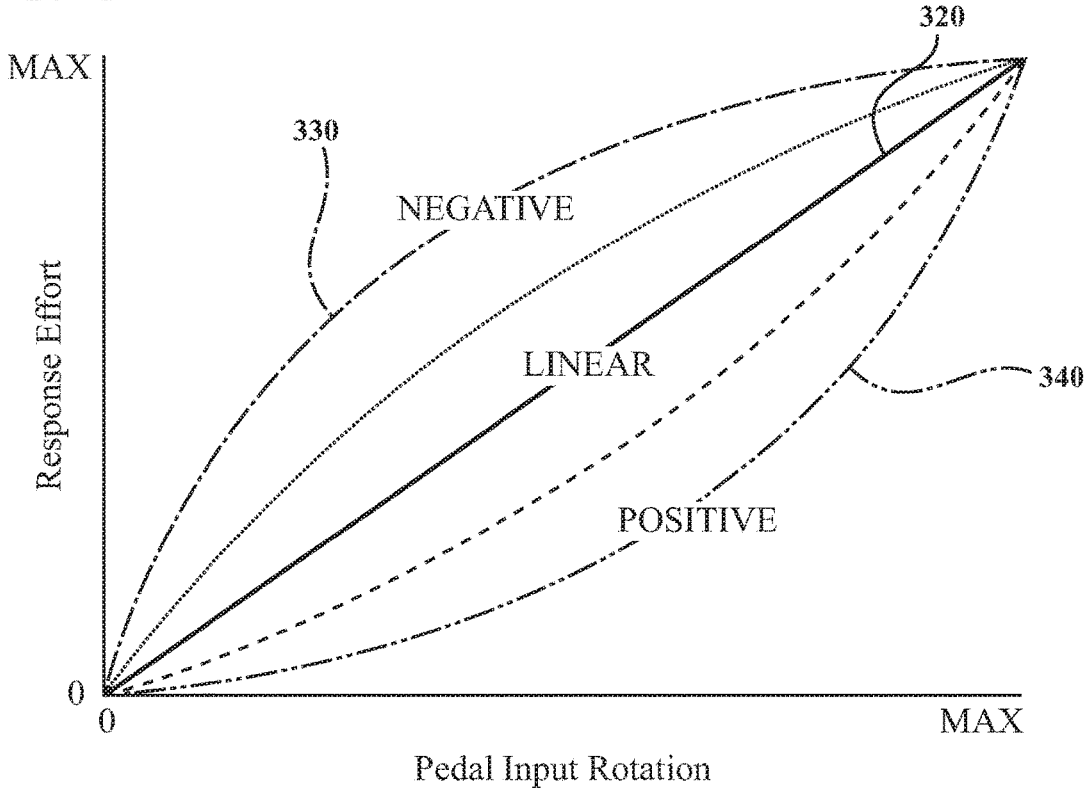
FIGS. 5 and 5A are graphs showing examples of linear and non-linear pedal response options mapped to pedal rotation.

Referring now to FIGS. 3 through 5, pedal 300 has a natural OFF position inclined toward the user, with pivoting footplate 302 resting with its forward toe end 302*a* down and its rear heel end 302*b* raised relative to base 304, biased to this position, for example, by a torsion spring (not shown) associated with transverse pivot 303 in known manner. The pivot 303 is offset forwardly from the midpoint of the footplate, and has a preferred proportional increase in resistance as the heel end 302*b* is depressed for better physio-kinetic response.

In the illustrated example of FIGS. 4A-4E, pedal 300 has a preferred 24° degree range of rotation, with its OFF or starting position inclined toward the user at approximately −12° from flat (FIG. 4A), and its MAX or full power position inclined away from the user at approximately +12° from flat (FIG. 4E). A pedal input sensor 310 located in or on base 304 is responsive to the rotational position of the pedal footplate 302 to send a signal to controller 200, which in turn controls the pulse rate/mode of the solenoid in graver 10. The positive pedal inclination is mapped to increases in the controlled effect, i.e. higher frequency, pulse width, burst speed, etc. the controlled effect depending on the selected pre-programmed operating mode. This is common for pedal operations, is ergonomic, and intuitive to the user. It will be understood that the pedal deflection range may be adjustable and/or user-selectable, and that the example range described herein is preferred but not limiting.

The pedal input sensor may comprise various known electromechanical or electronic means for sending a signal to the controller proportional to footplate rotation. In the illustrated example, the pedal input sensor 310 is a non-contact IR (infrared) reflective element 310*a* of known type in either the footplate 302 or base 304, the reflective element 310*a* optically coupled to an IR emitter/receiver 310*b* of known type in the opposing pedal member which generates a signal proportional to the distance between the reflector and emitter/receiver and delivers the signal via connection 250 to the controller 200. The opto-electronic nature of this preferred pedal input sensor arrangement eliminates mechanical features that can stick, wear, or malfunction. A potentiometer can also be used, as is common in the industry.

Still referring to FIGS. 3 and 4A-4E, controller 200 may be additionally programmed to establish adjustable dead zones associated with the OFF and MAX positions, i.e. where a pre-set degree of motion at either end of the pedal's range is calibrated by the controller to result in no change to the solenoid's operation. In the illustrated example, a START dead zone is established between −12° and −10° for a soft start, in which the solenoid in graver 10 is energized sufficiently to move it back and forth within the graver handle without striking the anvil, providing an audible and tactile signal that the graving operation is about to commence. A FINISH or MAXIMUM dead zone can be established between +10° and +12° to help ensure that the user is able to apply full power to the graver via the pedal. These example dead zone ranges are currently preferred, but may be varied according to user preference, for example by being programmed via controller 200 to cover different ranges of motion and then either incorporated automatically as part of a user-selected operating mode, or selected by the user via keypad interface 208 as an option for a particular operating mode.

Referring now to FIG. 5, pedal response can be programmed or "mapped" for both linear and non-linear responses to pedal rotation as measured by the pedal input sensor. A linear map such as that shown at 320 allows a 1:1 response of pedal rotational angle to output (i.e., pulse rate, frequency, output power, etc.); for example, a linear response map over a range of 1 Hz to 40 Hz over 20° provides 1.95 Hz per degree of controllability over the pedal rotation. Non-linear pedal response mapping may take different forms, for example the negative curve 330 and the positive curve 340 in FIG. 5. A negative curve 330 results in a fast onset of power/pulse rate, and the majority of response control is in the flat/50% to MAX range. A positive curve 340 results in more sensitivity and control at the lower power levels between OFF and flat/50%, with further pedal rotation providing less noticeable change in graver operation. Those skilled in the art will recognize that many different linear and non-linear response curves may be mapped over the operating range of the pedal and the solenoid in the graver, as mapping the variations in an input signal (i.e., from the pedal) to desired variations in an output signal from a controller is a well known technique. The pedal input is an electronic sensor that provides an input based on pedal rotation (depression). This signal ranges from a minimum response to a maximum response, all within a linear sampling window on the microprocessor in the controller. Treating the pedal response as a signal input, calibration and response mapping can be programmed and controlled. Typically a pedal will have a dead range in the beginning and an early maximum range at the end to take care of mechanical slop and wear. The controller can be programmed to set and calibrate a dead range, minimum and maximum active range, and any early maximum range as a factory or default setting, but menu-based programming can also allow the user to adjust these settings to suit his own needs and the conditions of the environment, such as a shorter rotational stroke of the pedal, or to offset the dead or maximum ranges for user preference, safety, or personal range of motion. The calibrated input signal from the pedal is sampled electronically and brought into the controller's microprocessor with ranges defined as off, minimum and maximum. Based on the span of minimum to maximum, the relationship of the input signal from the pedal to the output signal to the graver solenoid can be adjusted to provide different maps or response curves.

Figure 5A:
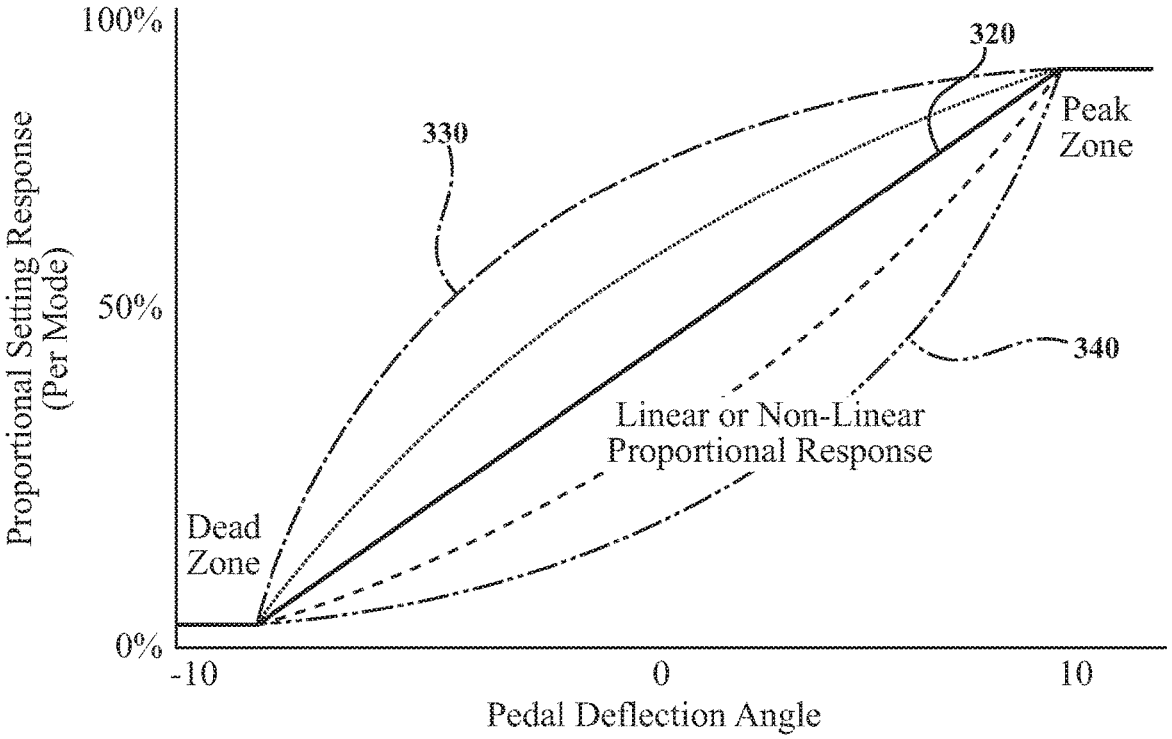

FIG. 5A shows the pedal response map of FIG. 5 modified with the START dead zone described above, established between −12° and −10° for a soft start, in which the solenoid in graver 10 is energized sufficiently to move it back and forth within the graver handle without striking the anvil, providing an audible and tactile signal that the graving operation is about to commence; and, with the FINISH or MAXIMUM dead zone established between +10° and +12° to help ensure that the user is able to apply full power to the graver via the pedal.

Figure 6A:
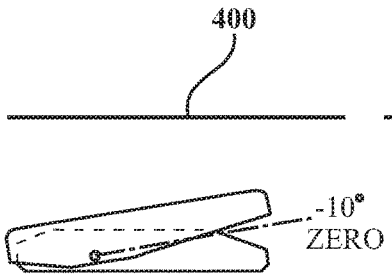
FIGS. 6A-6C are schematic representations of a pedal responsive pulse rate mapping method according to the invention.
Figure 6B:
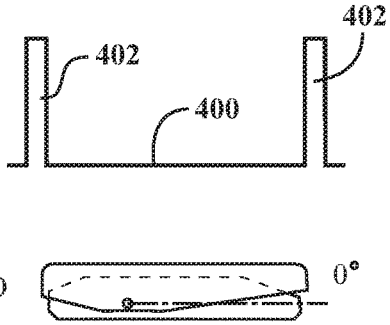
Figure 6C:
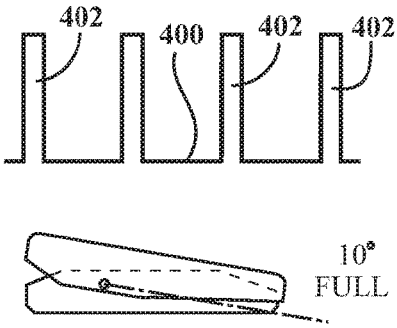

Referring now to FIGS. 6A-6C, an example pulse train mode of operation is illustrated schematically by relating a pulse frequency waveform 400 to pedal rotation. Example parameters might be:

| | |
|---|---|
| Selectable Active Pulse Width - | 0.2 msec-6.5 msec (0.1 msec increments) |
| Frequency Ranges - | 0.3 Hz-10 Hz/0.4 Hz-25 Hz/0.5 Hz-40 Hz, etc. |
| Pedal Controlled Frequency - | OFF through the selected frequency range |

FIG. 6A shows 0% controller-mapped graver response at −10° pedal rotational position, i.e. the graver is OFF or de-energized just prior to leaving the initial dead zone. FIG. 6B shows 50% graver response at the 0° or "flat" pedal rotational position. FIG. 6C shows 100% or FULL graver response at the 10° start of the terminal dead zone position at the end of the pedal's rotational range. The percentage response is a proportion of the selected frequency range from the table above, resulting in progressively faster-paced and/or more powerful pulses or strikes 402 to the graver anvil by the solenoid. The pulse train mode can be mapped with low enough frequency that a user can enable single "hits" of the graver anvil to the workpiece, if desired, at certain portions of the pedal's operating range.

Figure 7A:
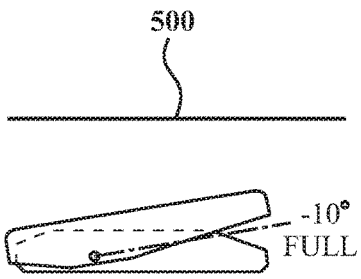
FIGS. 7A-7C are schematic representations of a pedal responsive pulse burst mapping method according to the invention.
Figure 7B:
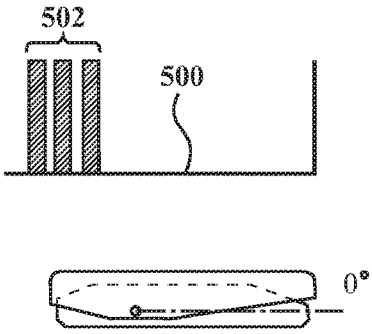
Figure 7C:
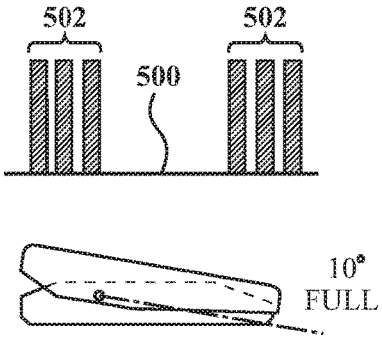

Referring now to FIGS. 7A-7C, an example pulse burst mode of operation is illustrated schematically by relating a pulse frequency-plus-burst-rate waveform 502 to pedal rotation. Example parameters might be:

| | |
|---|---|
| Selectable Pulse Width - | 0.2 msec-6.5 msec (0.1 msec increments) |
| Selectable Inter-Pulse Delay - | 10 msec-325 msec (5 msec increments) |
| Number of Bursts - | 1-15 per burst interval |
| Pedal Controlled Inter-Burst Time - | OFF, then 5 sec-0.8 sec (progressively shorter - 500). |

FIG. 7A shows 0% controller-mapped graver response at −10° pedal rotational position, i.e. the graver is OFF or de-energized just prior to leaving the initial or starting dead zone. FIG. 7B shows 50% graver response at the 0° or "flat" pedal rotational position, with a single three-strike burst 502 of a selected pulse width at a selected inter-pulse delay over the selected time interval but with increased time until the next pulse burst. FIG. 7C shows 100% or FULL graver response at the 10° start of the terminal max zone position at the end of the pedal's rotational range, with multiple three-strike bursts 502 over the shortened time interval. The percentage response is a proportion of the selected burst interval from the table above, resulting in progressively faster-paced bursts of strikes to the graver anvil by the solenoid. The burst mode can be mapped with low enough frequency that a user can enable single "bursts" of the graver anvil to the workpiece, if desired, at certain portions of the pedal's operating range.

FIGS. 8A-8C show a pulse width or duty cycle mapping example, with a fixed frequency and a variable active pulse width correlated to the pedal rotation or deflection, for a desired variation in the feel of the graver stroke depending on the pedal operation. As with the above pulse train and pulse burst modes, more than one variable pulse width "map" or operating mode may be pre-programmed into the controller for selection by a user.

In FIGS. 8A-8C, an example variable pulse width mode of operation is illustrated schematically by relating a pulse frequency 603 to pedal rotation. Example parameters might be:

| | |
|---|---|
| Select Frequency of Operation - | 1 Hz-60 Hz |
| Select Linearity Curve- | Negative Exponential, Linear, Positive Exponential |
| Selectable Maximum Pulse Width - | 0.2-6.5 msec (0.1 msec increments) |
| Pedal Controlled Pulse Width - | OFF to selected maximum pulse width increasing according to the linearity curve |

FIG. 8A shows 0% controller-mapped graver response at −10° pedal rotational position, i.e. the graver is OFF or de-energized just prior to leaving the dead zone. FIG. 8B shows an example of a lower pulse width generated as applied to the graver with a 50% pedal input at the 0° or "flat" pedal rotational position. FIG. 8C shows an example of 100% or maximum pulse width according to the user's selections as applied to the graver at the 10° start of the maximum zone position at the end of the pedal's rotational range, with longer pulses over the same frequency. The percentage response is a proportion of the selected maximum pulse width from the table above, resulting in progressively longer duration pulses or strikes 602 to the graver anvil by the solenoid, with a fixed frequency denoted by bracket 603 in the Figures; the pedal adjusts the on periods of the pulse width, which can be viewed as duty cycle. The variable pulse width mode can be mapped with low enough frequency that a user can enable single "hits" of varying pulse width from the graver anvil to the workpiece, if desired, at certain portions of the pedal's operating range.

Referring again to FIG. 3 (and FIG. 9), the operation of controller 200 to set the desired graver response relative to pedal input is preferably menu driven via display 202. A menu tree of generally known type may be established for programmable and user-selectable features such as configurations, power levels, status, operating temperatures, operating modes, and the like, as will be apparent to those skilled in the art.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A handheld graver comprising:

a fixed-position graver tip held in a forward end of a heat-conductive metal stylus tube;

a hollow rear handle section comprising a wall of heat-insulating material;

a solenoid unit mounted in the hollow rear handle section, the solenoid unit comprising a plunger reciprocating in a heat-conductive metal solenoid housing, the plunger connected to an actuator rod extending through a forward interface end of the solenoid housing to selectively engage an anvil in contact with the graver tip in the stylus tube;

the forward interface end of the solenoid housing connected to the stylus tube with a heat sink connection comprising a heat-conductive metal-to-metal connection, and further comprising a plurality of heat-convective fins extending outwardly from an outer surface of the forward interface end of the solenoid housing adjacent the heat-conductive metal-to-metal connection; and, the hollow rear handle section connected to a rear end of the solenoid housing at a rear insulating connection via a rear portion of the wall of heat-insulating material, the hollow rear handle section further defining an insulating air gap spacing the wall of heat-insulating material of the hollow rear handle section from the heat-convective fins and from a remainder of the solenoid unit forwardly of the rear insulating connection.

2. The handheld graver of claim 1, wherein the hollow rear handle section further comprises air flow holes adjacent the forward interface end of the solenoid housing, the air flow holes communicating ambient air to the heat-convective fins and to the interior of the hollow rear handle section around the solenoid housing.

3. In combination with the handheld graver of claim 1, a control system comprising a foot pedal and a controller, the foot pedal communicating with the controller and the controller communicating with the graver to supply electrical power to the solenoid unit in the graver to control the plunger for different pulse effects in response to different pedal input signals corresponding to different foot pedal positions inclined away from the user.

4. The combination of claim 3, wherein a pedal response range is set by the controller with adjustable dead zones at minimum and maximum ends of the pedal response range in which a pre-set degree of motion at either end of the pedal response range results in no change to the operation of the solenoid unit in the graver.

5. The combination of claim 3, wherein the different pulse effects comprise different pulse frequencies.

6. The combination of claim 3 wherein the controller maps the pedal input signal to selectable linear and non-linear control of the different pulse effects.

7. The combination of claim 3, wherein the different pulse effects comprise different pulse widths.

8. The combination of claim 3, wherein the different pulse effects comprise different pulse burst patterns.

9. The combination of claim 3, wherein the different pulse effects include a soft start in which the solenoid unit is activated to reciprocate the plunger in the handheld graver without striking the graver tip.

10. The handheld graver of claim 1, wherein the rear end of the solenoid housing comprises an open cylinder closed with a length-adjustable backstroke stop threadably mated with the rear end of the solenoid housing and comprising an inner plug portion extendable an adjustable distance into the solenoid housing to limit a backstroke of the plunger.

11. The handheld graver of claim 10, wherein the backstroke stop comprises a heat insulating material.

* * * * *